United States Patent [19]

Utting

[11] 4,166,494

[45] Sep. 4, 1979

[54] MOVABLE CURTAIN PARTITION

[76] Inventor: Peter R. Utting, 47 Wentworth Ave., Sydney, New South Wales, Australia, 2000

[21] Appl. No.: 852,936

[22] Filed: Nov. 18, 1977

[30] Foreign Application Priority Data

Dec. 7, 1976 [AU] Australia ..... PC 8391

[51] Int. Cl.[2] ..... A47H 1/00

[52] U.S. Cl. ..... 160/330; 16/97

[58] Field of Search ..... 160/330, 345, 196, 357, 160/133; 104/94, 95, 106–109; 105/149, 154, 155, 163, 376; 211/162; 16/87 R, 87.2, 87.4, 97, 98

[56] References Cited

U.S. PATENT DOCUMENTS

| | | | |
|---|---|---|---|
| 1,674,748 | 6/1928 | Tobin et al. | 16/97 |
| 1,821,697 | 9/1931 | Ferris | 16/97 |
| 2,839,135 | 6/1958 | Anderson | 160/133 |
| 3,376,599 | 4/1968 | Singer | 160/196 |
| 3,843,995 | 10/1974 | Merrill | 16/105 |

*Primary Examiner*—Peter M. Caun

*Attorney, Agent, or Firm*—Christie, Parker & Hale

[57] ABSTRACT

A movable curtain partition has bogie-type supports at each end, which move on corresponding guide surfaces of fixed spaced apart tracks.

5 Claims, 6 Drawing Figures

1
2
3
4
5
6
7
8
9
10
11
12
13
14
15
16

6
13
15
16
17
18
19
20
21
22
23
24
25
26
27
28
29
30
31
V

MOVABLE CURTAIN PARTITION

The invention relates to movable curtain partitions and in particular to such partitions used in connection with other curtain separators.

Curtain partitions are widely used for various purposes, but one of their main applications is in hospitals where they are used to separate on a rather permanent basis certain sections of a hospital ward. Individual curtains on fixed rails have also been used for screening individual beds of a hospital ward.

There is, however, also a need in hospitals and other establishments for movable curtain partitions to allow for a changeable sub-division of part of a certain prescribed area. Difficulties have been experienced, however, in providing such facilities, as, generally, at least one of the two walls between which the movable curtain partition is to extend, is formed itself by a curtain suspended from a curtain rail. Such rails are often rather flexible and thus it has been found that it is difficult to move the mono-rail parallel to the supporting walls unless force is exerted on it exactly in the centre between the supporting wall on one side and the curtain rail on the other side, as otherwise the mono-rail will jam.

It is an object of this invention to devise an arrangement for a movable curtain partition which permits movement of the partition from any point along its track without jamming.

This object is achieved, according to the invention by a movable curtain partition extending between and normal to spaced apart substantially parallel tracks having guide surfaces thereon, said partition having a mono track, a curtain suspended therefrom, and a bogie-type support at each end of said mono track, each support including at least one horizontal and one vertical guide wheel at each end thereof, linking means to connect said mono track with its corresponding bogie-type support about halfway between said guide wheels, said guide wheels being adapted to engage corresponding guide surfaces of said spaced apart tracks for guidance of said mono track during movement along said tracks.

One embodiment of the invention will be described hereinafter in more detail in connection with the drawings in which:

FIGS. 1 and 2 shown in plan view and in perspective a lay-out for a curtain arrangement incorporating the movable partition according to the invention;

Figures 1, 2:
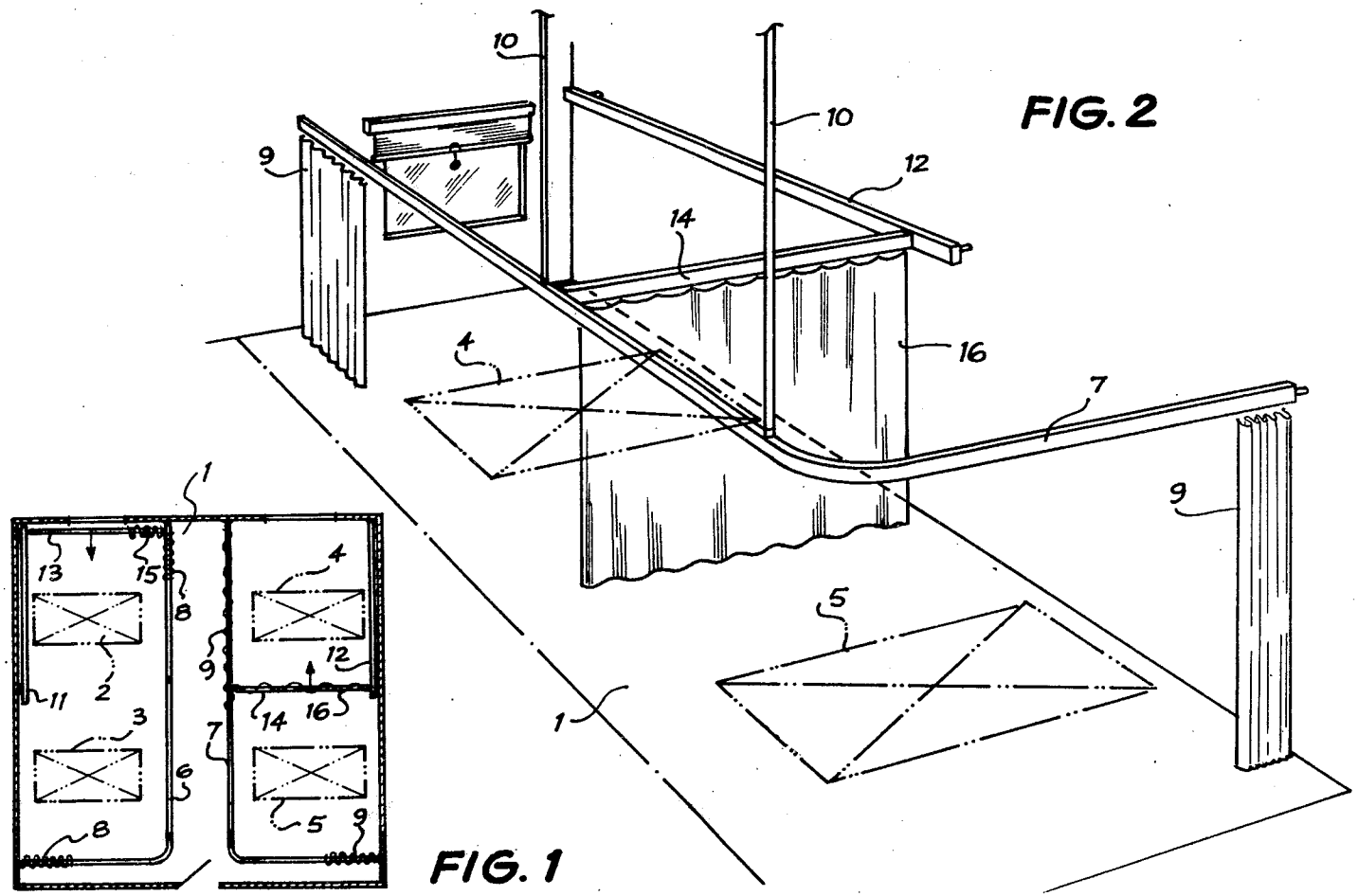

FIG. 1 shows a ward in a hospital having a centre passage 1 and beds 2, 3 and 4, 5 on each side thereof. Curtain rails 6 and 7 extend along the passage and one side of the ward, having curtains 8 and 9 slidable thereon. The curtain rails 6 and 7 are suspended from the ceiling by suspension rods 10 as can be clearly seen from FIG. 2 showing a perspective view of part of the ward.

The curtain rails 6 and 7 together with tracks 11 and 12 fixed to opposite walls of the ward form supporting tracks for movable partitions composed of the mono tracks 13 and 14 and curtains 15 and 16 suspended thereon.

As these partitions have only to be moved up to the space between two beds, the tracks 11 and 12 extend only over one half of the ward walls.

In FIG. 1 the mono track 13 is shown in its parked position, from where it can be moved in the direction of the arrow to an operative position as shown by mono track 14 in FIGS. 1 and 2.

Figures 3, 4:
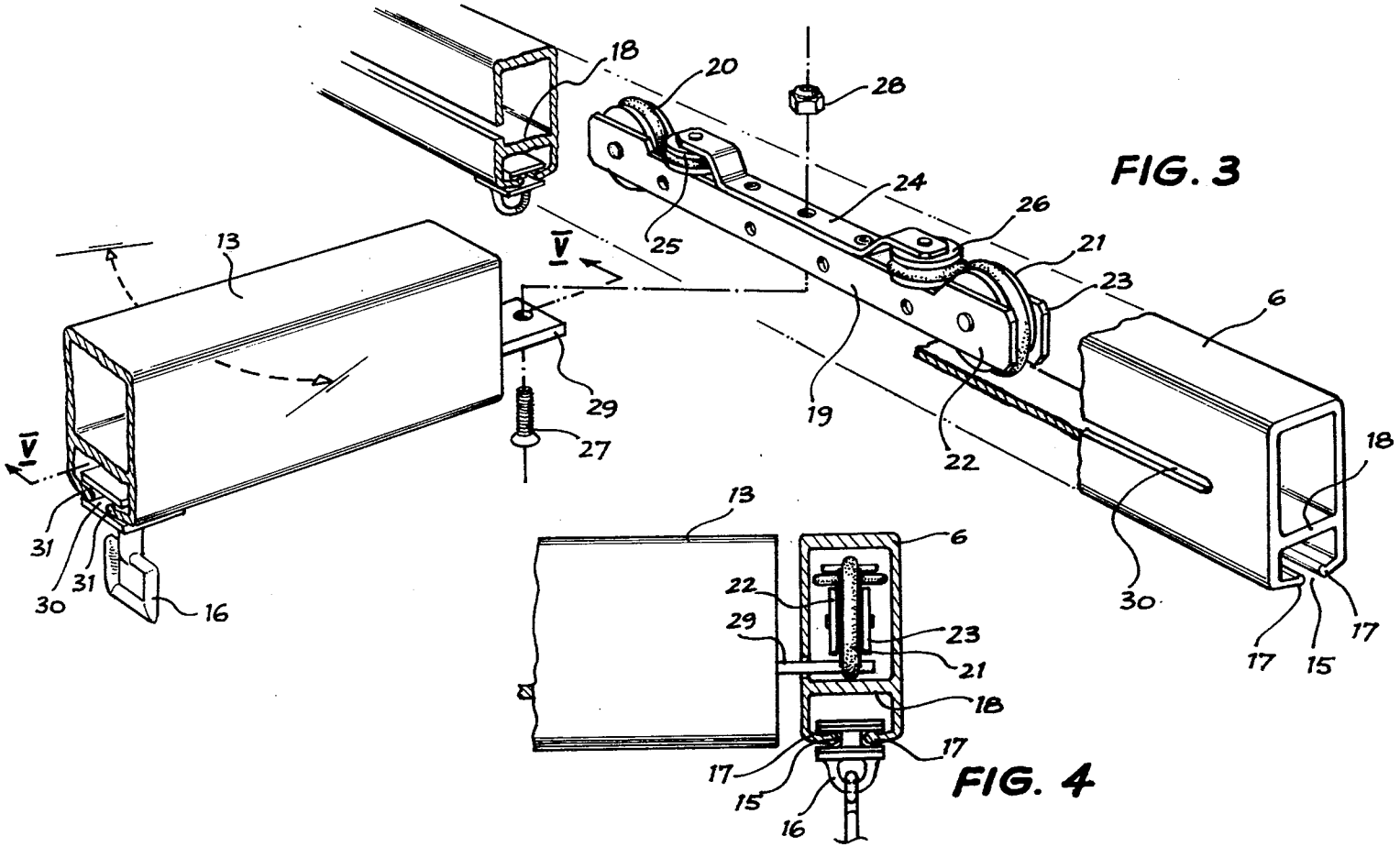
FIG. 3 is a perspective view partly in section of the movable partition and its connection with one of its guiding tracks.
FIG. 4 is a cross-section through one of the guide tracks showing the partition support movable therein.
Figure 5:
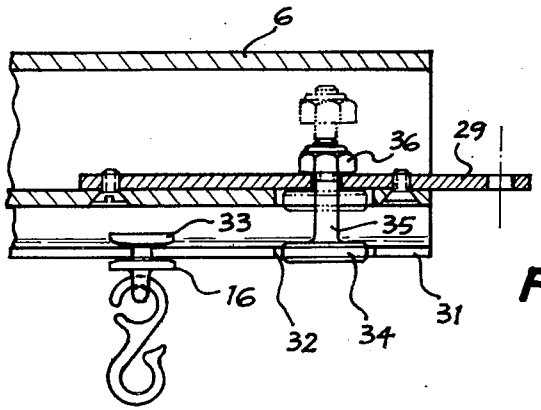
FIG. 5 shows a cross-section through the movable partition along line V with a retaining device for curtain hooks.

The mono tracks 13 and 14 are movably supported on the rails 6, 7 and tracks 11, 12 by bogie-type supports, one on each end as will be described hereinafter in connection with FIGS. 3, 4 and 5 showing one end of mono track 13 supported on one end by the curtain rail 6 and on the other end (not shown) by the track 11.

The rail 6 consists of an extruded hollow aluminium section having a rectangular cross-section, slotted at the bottom to form a path 15 for curtain hooks 16 supported by the two edges 17. A partition wall 18 forms one guide surface for the bogie-type mono track support 19, as will be described hereinafter.

The support 19 has two vertical wheels 20, 21 mounted for rotation between side plates 22, 23. These side plates are connected by a top plate 24 which supports two horizontal wheels 25, 26 rotatable thereon. The centre part of the support 19 is connected by a bolt 27 and nut 28 with a lug 29 extending from the mono track 14 as can be seen from FIGS. 3 and 5.

In order to cater for minor variations in the spacing between the track 11 and the curtain rail 6 the link between the mono track 13 and the bogie 19 can be made adjustable, for example by an elongated hole in the end of lug 29.

The rail 6 is also slotted at one side to form a passage 30 for the lug 29 after the support 19 has been pushed into the rail 6 from one open end thereof. The vertical and horizontal wheels 20, 21 and 25, 26 of the support 19 are so dimensioned that when they are in contact with a horizontal and vertical inner surface respectively of the curtain rail 6, there is only a very small clearance between the wheels and the opposite surfaces. Thus irrespective of any canting force applied to the mono track 14 during its movement along the rail 6 and track 11 the vertical and horizontal wheels of the support 19 will always remain in contact with one or the other of the inner surfaces of rail 6.

The tracks 11 and 12 have the same configuration as the curtain rails 6 and 7, but when mounted on the walls of a ward, do not require any curtain hook guides formed by the edges 17.

The mono track 13 carries a bogie at each end, one of them moving in the curtain rail 6 as shown in FIGS. 3 and 4 and the other in the corresponding track 11.

The cross-section of the mono track 13 and 14 is similar to the cross-section of the curtain rails 6 and 7 providing a slot 30 (FIG. 3) to guide the curtain hooks 16 between edges 31.

To facilitate the insertion of the curtain hooks 16 into the slot 30 an opening 32 (FIG. 5) is provided in the edges 31, which is large enough to allow the top part 33 of the hooks 16 to pass therethrough. This opening is closed by a disc 34 mounted on a stud 35 slidable in a corresponding opening in the lug 29. The stud 35 carries a nut 36 so adjusted that the disc 34 is flush with the lower surface of the edges 31. To insert a curtain hook 6 the disc 34 is pushed upwards and the top part 33 of the hook is pushed along the slot 30. The disc 34 then returns under gravity to its original position closing the opening 32 and preventing any hook from falling out again.

Figure 6:
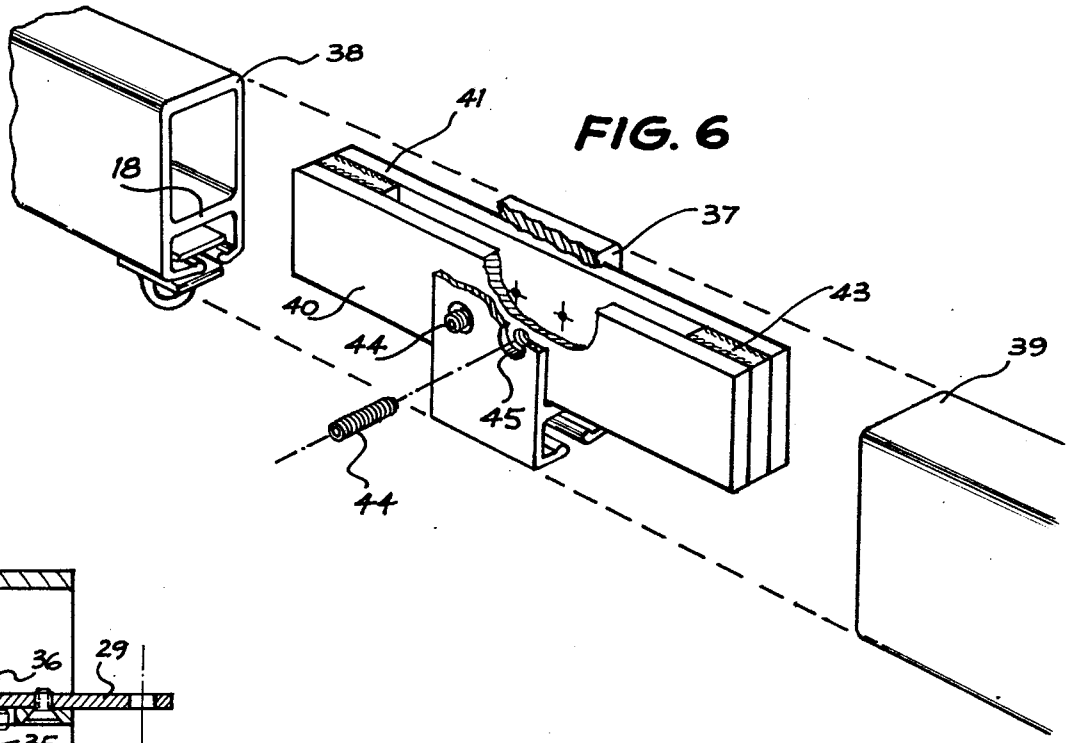
FIG. 6 is a perspective view of a connector suitable for connecting two lengths of track together.

An arrangement for quick connection of two lengths of mono track is shown in FIG. 6. This arrangement permits the connection to be made in situ without any special treatment of the mono track sections. The arrangement consists of a short section 37 of the same cross-section as the mono track sections 38 and 39 which are to be connected. Two metal strips 40 and 41 spaced apart and joined by spacers 42 and 43 are so designed that they fit with a sliding fit into the mono track sections 38 and 39. These metal strips pass through the opening in the short section 37 and are fixed therein by grub screws 44 passing through corresponding holes 15 in section 37 and being screwed into the strip 40 until they tough the inner surface of the strip 41. After the metal strips have been inserted into the track sections 38 and 39 so that the ends of these sections abut opposite sides of the short section 37, the grub screws 44 are tightened, thereby forcing the metal strips 40 and 41 apart. In this way the metal strips 40 and 41 are jammed tight in the respective sections 38 and 39 providing a simple and effective joint between the sections and an uninterrupted path for the curtain hooks. Disassembly of the joint can be carried out by simply releasing the screw pressure on the metal strips.

The foregoing description refers to one embodiment of the invention employing a mono track between a roof-suspended curtain rail and a wall-mounted track. It must be understood, however, that the invention equally applies to mono-tracks extending between two curtain rails or two wall-mounted tracks.

I claim:

1. A movable curtain partition extending between and normal to spaced apart substantially parallel first and second tracks, each track having thereon a horizontal upper facing guide surface and a pair of spaced vertical guide surfaces, said partition having a mono track, a curtain suspended vertically down therefrom, and a bogie-type support at each end of said mono track which corresponds to a different one of said first and second tracks, each support including opposite sides and at least one horizontal and one vertical rotatable guide wheel, arranged in a pair, at each end thereof, each horizontal guide wheel extending horizontally beyond the opposite sides of the corresponding bogie-type supports, linking means to connect said mono track with each of the bogie-type supports about halfway between the pair of guide wheels thereof, and said vertical guide wheels being adapted to continuously engage horizontal upper facing guide surfaces of the corresponding first and second tracks for guidance of said mono track along a horizontal plane during movement along said tracks, the horizontal upper facing guide surfaces permitting the vertical wheels to move from side to side, and said horizontal guide wheels being adapted to engage both vertical guide surfaces of the corresponding first and second tracks so as to stop the side movement and prevent the opposite sides of the bogie-type supports from engaging the tracks.

2. A movable curtain partition according to claim 1 in which the mono track has a hollow rectangular cross-section and two oppositely inwardly bent rails for movably supporting curtain hooks having an enlarged head.

3. A movable curtain partition according to claim 2 in which at least at one end of the mono track the inwardly bent rails have a recess each, said recesses together forming an opening larger than the enlarged heads of said curtain hooks, a closure member in said opening, said closure member, being guided for upward movement and returning to its position in said opening under gravity.

4. A movable curtain partition according to claim 2 having at least one joining member to join two lengths of mono track sections together, said joining member consisting of a short section of mono track cross-section, two parallel and spaced apart metal strips inserted into said section and protruding at each side thereof, said strips being joined at their ends by spacers to fit with a sliding fit into the mono track sections to be joined, and screws passing through holes in said short section, and screwed into one of said metal strips and pressing against the other of said metal strips.

5. A movable curtain partition extending between and normal to spaced apart substantially parallel first and second tracks, said tracks being hollow and of rectangular cross-section and forming two internal pairs of a horizontal upper facing and a pair of opposed spaced vertical guide surfaces, said partition having a mono track, a curtain movably suspended vertically down therefrom, and a bogie-type support at each end of said mono track, which corresponds to a different one of said first and second tracks, each support including a pair of guide wheels at each of its ends, the wheels of each pair having their centre axes arranged at right angles to each other with a first guide wheel of the pair of adapted to continuously engage the horizontal upper facing guide surfaces and a second guide wheel of the pair extending horizontally beyond the opposite sides of the corresponding bogie-type supports, said bogies being movable along a horizontal plane within said tracks whereby said pairs of wheels contact one or the other of said pairs of vertical guide surfaces, the diameter of said second wheel of each pair being only marginally smaller than the spacing between corresponding opposed vertical guide surfaces, the horizontal upper facing guide surfaces permitting the first guide wheel of each pair to move from side to side, and said second guide wheel of each pair being adapted to engage both vertical guide surfaces of the corresponding first and second tracks so as to stop the side movement and prevent the opposite sides of the bogie-type supports from engaging the tracks, a longitudinal slot in each of said tracks and linking means passing through said slots to connect the ends of said mono track with said bogie-type supports halfway between said pairs of wheels.

* * * * *